US005595408A

United States Patent [19]

Jeche

[11] Patent Number: 5,595,408

[45] Date of Patent: Jan. 21, 1997

[54] SAFETY DOOR AND SAFETY APPARATUS FOR INSTALLATION IN A DOOR

[76] Inventor: Peter Jeche, Hausstockweg 49. DE 12107, Berlin, Germany

[21] Appl. No.: 386,352

[22] Filed: Feb. 8, 1995

[30] Foreign Application Priority Data

Feb. 8, 1994 [DE] Germany ..... 44 03 870.4
Jul. 4, 1994 [DE] Germany ..... 9411037 U

[51] Int. Cl.[6] ..... E05C 1/06
[52] U.S. Cl. ..... 292/37; 292/36
[58] Field of Search ..... 292/36, 37, 33, 292/42

[56] References Cited

U.S. PATENT DOCUMENTS

| | | | |
|---|---|---|---|
| 819,460 | 5/1906 | Rooney . | |
| 2,390,731 | 12/1945 | Oxhandler | 292/37 |
| 4,834,435 | 5/1989 | Kleefeldt | 292/DIG. 56 X |
| 5,067,755 | 11/1991 | James | 292/33 |
| 5,094,483 | 3/1992 | James | 292/39 |
| 5,341,752 | 8/1994 | Hambleton | 292/36 X |
| 5,375,894 | 12/1994 | Schlack | 292/36 |
| 5,472,247 | 12/1995 | Monson | 292/36 |

FOREIGN PATENT DOCUMENTS

| | | | |
|---|---|---|---|
| 4128213 | 3/1993 | Germany . | |
| 385145 | 12/1923 | United Kingdom | 292/36 |
| 2133456 | 7/1984 | United Kingdom . | |
| 2199362 | 7/1988 | United Kingdom . | |

*Primary Examiner*—Rodney M. Lindsey
*Assistant Examiner*—Monica E. Millner
*Attorney, Agent, or Firm*—Helfgott & Karas, P.C.

[57] ABSTRACT

A safety door has safety bolts provided at two opposite peripheral edges of the door leaf. By a locking mechanism apparatus, the safety bolts can be shifted into assigned guideways in such a manner, that they protrude beyond the corresponding peripheral edge of the door leaf in a locked position and are accommodated in the door leaf in an unlocked position. The locking mechanism apparatus has a slide rod which can be shifted in its longitudinal direction essentially transversely to the guideways and with which the safety bolts are mechanically coupled. Precisely one safety bolt is carried in each guideway. The safety bolts assigned to the one peripheral edge and those assigned to the opposite peripheral edge are disposed offset to one another.

11 Claims, 6 Drawing Sheets

SAFETY DOOR AND SAFETY APPARATUS FOR INSTALLATION IN A DOOR

BACKGROUND OF THE INVENTION

The present invention relates to a safety door, in which safety bolts are provided at two mutually opposite peripheral edges of the door leaf and can be shifted by means of a locking mechanism apparatus in assigned guideways in such a manner that, in a locked position, they protrude beyond the corresponding peripheral edge of the door leaf and, in an unlocked position, are accommodated within the door leaf, the locking mechanism apparatus comprising a slide rod, which can be shifted in its longitudinal direction and runs essentially transversely to the guideways and with which the safety bolts are coupled mechanically. The invention furthermore relates to a safety apparatus for subsequent installation in a door to produce a safety door of the aforementioned type.

A generic safety door is known from U.S. Pat. No. 819,460. For this safety door, two safety bolts, which can be moved in opposite directions to one another by means of the locking mechanism apparatus, are guided in each pipe, which extends transversely over the whole width of the door and serves as guideway for the safety bolts. In addition, two wedge mechanisms, disposed next to one another for shifting the two safety bolts of the corresponding pipe, are provided in the slide rod assigned to each pipe. The wedge mechanisms, thus disposed in pairs, comprise in each case two inclined elongated hole guideways, which run symmetrically to the longitudinal axis of the slide rod and are engaged by operating pins of the safety bolts.

It is a serious disadvantage of this known safety door that the locking mechanism apparatus is very wide. In particular, the appreciable width of the slide rod prevents entry doors to residences or houses, which must also meet aesthetic requirements, being constructed as safety doors in accordance with U.S. Pat. No. 819,460, since paneling, coveting the locking mechanism apparatus, would occupy about one-third the width of the door and thus disfigure it.

A further genetic safety door is known from GB-A-2133456. For this safety door, pipes for guiding the safety bolts are inserted in the door leaf and extend in each case from a peripheral edge up to a housing countersunk in the door. In those housings, guide rod mechanisms are accommodated, which are assigned to the locking mechanism apparatus. By means of these control mechanism apparatuses, the movement of a slide rod, comprising two vertically extending sections that can be moved in opposite directions, can be converted into horizontal motions of the safety bolt. The two pipes, ending in each case in one housing, are disposed coaxially. Accordingly, in each case also two safety bolts, provided at mutually opposite peripheral edges of the door, lie on one line. It is a disadvantage of this known safety door that the guide rod mechanism occupies relatively much space. For aesthetic reasons, therefore, it is countersunk in the door. This, in turn, makes the subsequent re-equipping of a conventional door into a safety door almost impossible.

The GB-A-2 199 362 discloses a further safety door, which differs from the initially described genetic safety door essentially owing to the fact that two slide rods are provided instead of one, namely one each adjacent to the respective peripheral edge of the door, at which the safety bolts are provided. Each slide rod operates the safety bolts provided at the associated peripheral edge of the door. Furthermore, each of the two slide rods is divided into two slide rod sections working in opposite directions. The two sections of each slide rod are connected over wedge mechanisms with one operating rod each, which in turn can be shifted in its longitudinal direction, that is, transversely to the slide rods, by the centrally disposed lock. As in the case of the safety door of U.S. Pat. No. 819,460, in each case two safety bolts, provided at mutually opposite peripheral edges, are disposed coaxially to one another on one line.

With this safety door also, the space required for the locking mechanism apparatus is disadvantageous. In particular, the dimensions of the locking mechanism apparatus prevent a residence or house door, which is not ugly, being constructed pursuant to GB-A-2 199 362.

A further safety door, as well as an apparatus for re-equipping a conventional door into a safety door are known from the German patent 4128213. For this known door, the metal pipes, passing through the door leaf, extend over the whole width of the door leaf. In the ends of each of the pipes, two safety bolts working in opposite directions to one another are provided. Thus, in the locked position, each pipe is fixed over the two safety bolts protruding out of the door leaf and engaging the door frame. To operate the safety bolts, a slide rod, which comprises two sections that can be moved in opposite directions and is vertically displaceable, is provided. The two safety bolts of each pipe are coupled to the assigned section of the slide rod by means of two guide rods, which convert the vertical motion of the slide rods into horizontal motion of the safety bolts.

For this known safety door, it is also of disadvantage that the operating mechanism for the safety bolts is constructed relatively wide. If the safety bolts are to protrude in their locked position, as is customary, 20 mm from the peripheral edge of the door, the operating mechanism for the safety bolts can hardly be accommodated under a covering less than 12 cm wide. Especially in the case of the doors of old buildings, decorated with panels or the like, a continuous area of this width is frequently not available. Doors of old buildings can therefore frequently not be re-equipped to form the known safety door. Moreover, it is practically impossible to operate the additional safety apparatus by means of a lock disposed at the conventional place in the door; rather, an additional lock is usually required, the sole function of which is to operate the safety apparatus. This makes it more difficult to handle the door.

SUMMARY OF THE INVENTION

It is an object of the present invention to provide a generic safety door or an apparatus for producing a safety door, for which the operating mechanism for the safety bolts is particularly narrow. It shall also be possible to construct house and residence doors in this way, without having them appear to be unattractive.

Pursuant to the invention, this and other objects are accomplished for a safety door of the generic type owing to the fact that precisely one safety bolt is carried in each guideway and that the safety bolts assigned to the one peripheral edge and the safety bolts assigned to the opposite peripheral edge are disposed offset to one another. The offset arrangement of the safety bolts with respect to one another enables the means, which engage the safety bolts directly in order to operate them, to be provided in staggered fashion. Since only one safety bolt need thus be operated on the level of each guideway, which preferably is constructed as a pipe, and, moreover, operated either at the one peripheral edge or at the opposite peripheral edge of the door, the operating mechanism can be constructed so as to be very much narrower than it is in all known safety doors. In the case of the inventive door, the width of the operating mechanism is thus reduced owing to the fact that this mechanism serves not for operating two, but rather for operating only one safety bolt per pipe level. In the case of the operating mechanism by means of guide rods, which is known from the German patent 4128213, as well as in the case of the safety door with safety bolts operated by wedge mechanisms and known from U.S. Pat. No. 819,460, the width of the operating mechanism is reduced to about one third by means of the inventive measure. Due to the correspondingly narrower construction of the operating mechanism, the latter can be covered by means of a considerably narrower covering strip. In particular, the operating mechanism can be covered with a covering, the width of which is not greater than that of the metal fittings normally provided on the inside of doors. Aside from aesthetic advantages, this has, in particular, the advantage that almost all doors, including those with panels and other decorations, can be re-equipped by subsequently installing the inventive apparatuses in safety doors. Since a part of the safety bolts act at one peripheral edge of the door leaf and the remaining safety bolts act at the opposite peripheral edge of the door leaf, the security, provided by the inventive safety door against breaking and entering is not disadvantageously affected to any degree worth mentioning relative to the known safety door. By means of suitable additional characteristics, which are preferably provided and described further below, it can even be achieved that the security, provided by the inventive safety door against breaking and entering, is even increased beyond that of the known safety doors.

To operate the safety bolts, a slide rod is provided, which can be shifted in its longitudinal direction, extends transversely to the pipes and is connected effectively with the safety bolts. If the pipes are disposed horizontally in the door leaf, the slide rod for operating the safety bolts is aligned vertically and can be shifted vertically. Preferably, a single slide rod is provided to operate all safety bolts.

However, if the slide rod for operating different groups of safety bolts has several sections, then these sections are advisably disposed in a line. The safety bolts can be connected through guide rods with the slide rod, as is the case with the safety door of the German patent 4128213. In a preferred further development of the inventive door, however, provisions are made so that the safety bolts are coupled over wedge mechanisms with the slide rod, the wedge mechanisms transforming the vertical motion of the slide rod into horizontal motions of the safety bolts. For this purpose, the slide rod advisably has a flat, wide cross section and elongated-hole guideways, which run obliquely to the longitudinal direction of the slide rod, are provided in it. These elongated-hole guideways are provided for operating pins, which protrude laterally from the safety bolts, which are to be operated. An operating mechanism for the safety bolts, so designed, has only minimal dimensions with respect to the width as well as with respect to the height. The slope of the elongated-hole guideways in the slide rod depends on the frictional relationships and thus also on the number of safety bolts, which are to be operated; in general, however, the starting point is a slope of 45°. For this refinement, the operating mechanism can then also be accommodated under a covering strip, which is about 4 cm wide, if the safety bolts, as is customary, protrude 20 mm beyond the peripheral edge of the door leaf in the locked position. This is a very decisive advantage over the state of the art, which requires, as has been explained, a covering strip about 12 cm wide or wider.

The safety bolts are disposed preferably so that they act at the lower and upper edge of the door leaf on the lock side and in between, however, on the hinge side. For doors of conventional dimensions, it is particularly advantageous to have six laterally acting safety bolts, of which the two lower and the two upper act on the lock side and the two in the middle act on the hinge side. This distinguishing feature serves to increase the security, provided by the inventive safety door against breaking and entering. The further, preferred distinguishing feature provided serves for the same purpose. According to this feature, the pipes pass as far as possible through the door leaf or extend even transversely through the whole of the door leaf. The security, provided by the inventive safety door against breaking and entering, increases with the number of pipes with safety bolts that are provided.

A preferred further development of the inventive door, for which the pipes extend transversely through the whole of the door leaf, is characterized in that the pipes are connected at their two ends with installation holding straps, which extend along said peripheral edges of the door leaf and connect all pipes with one another. In this way, a rigid grill is formed from the two installation holding straps and the pipes extending between these. This grill, which stiffens the door leaf, is then fixed as such in the frame when the safety bolts engage the seats in the door frame. Even in doors having a minimum inherent stiffness, a safety door results from these means, which satisfies the highest requirements with respect to security against breaking and entering. Advisably, the lock box, which is provided for operating the locking mechanism apparatus for the safety bolts, is firmly connected with one of the two installation holding straps. This reduces the expense of re-equipping conventional doors so as to form inventive safety doors.

In view of the fact that it is possible to convert conventional doors into inventive safety doors, provisions are advisably made so that the ends of the pipes for guiding the safety bolts are fastened at the installation holding strip on the lock side, preferably by means of angle pieces, which are welded to the pipes and bolted to the corresponding installation holding strap. Seats are provided on the installation holding strap on the hinge side for the free ends of the pipes fastened to the installation holding strap on the lock side. The seats (bushings or bolts) preferably are so long, that they can compensate for door leaves of different widths. The "comb-like" unit of installation holding strap and pipes fastened to the strap is mounted from the lock-side peripheral edge of the door leaf, the pipes entering corresponding cavities in the door. When the pipes have been inserted completely into the corresponding cavities in the door leaf, their free ends engage the seats provided in the installation holding strap on the hinge side to form the grill described above.

Advisably, to guide the slide rod, a guide bar with a C profile is provided, which is placed outside on the inside of the door leaf. This guide bar embraces the outer edge of the slide rod. Advisably, it is made from a material with a low coefficient of friction or is provided with a friction-reducing coating. Advisably, although not absolutely necessarily, elongated-hole guideways are produced in the guide bar. Corresponding to the alignment of the elongated holes provided in the pipes, said elongated-hole guideways extend transversely to the longitudinal direction of the guide bar and carry the operating pins of the safety bolts. The guide bar replaces the conventional metal fittings on the inside of the door. This means that the guide bar functions as an anchoring bracket for fastening the fitting provided on the outside of the door, in that the guide bar is connected with the fitting on the outside of the door by means of the fastening elements (such as bolts) passing through the door leaf. It has openings for the latch as well as for the lock cylinder.

The narrow construction of the operating mechanism for the safety bolts enables a covering strip, which covers these bolts, to be no wider than the usual metal fittings on the inside of a door. A corresponding covering strip for the operating mechanism of the safety bolts also has openings for the latch and for the lock cylinder of the lock. Not only is this an optimum solution for aesthetic reasons, but also any problems with placing the operating mechanism are eliminated, because practically all doors, even if they are decorated by panels or the like, have a continuous edge in the region of the metal fittings, which enables the operating mechanism to be installed. In this case, the lock box, which is provided anyhow, is advisably constructed as a double lock with two locking mechanisms, one of the locking mechanisms acting on the vertically movable slide rod assigned to the locking mechanism apparatus and the second locking mechanism acting on the usual bolt that protrudes from the circumferential edge of the door. An advantage of such a configuration for the inventive door lies therein that such a door can make do with a single lock. It is therefore not possible to see from the outside that the door is a safety door, secured against breaking and entering. Moreover, only a single key is required for opening and locking the door and not two keys, as is the case with the state of the art.

If so desired, it is, however, also possible within the scope of the invention to provide a separate lock for operating the safety bolts.

To guide the operating pins, which enter the pipes laterally and act on the safety bolts, friction-reducing guiding inserts can be inserted in the elongated holes of the door leaf corresponding to the elongated holes provided in the pipes, Such guiding inserts are advisably provided particularly when a guide bar with a C-shaped profile, which already has the elongated-hole guideways for guiding the operating pins in the direction of the longitudinal axis of the pipes, is not provided for guiding the slide rod.

DETAILED DESCRIPTION OF THE PREFERRED EMBODIMENTS

Figure 1:
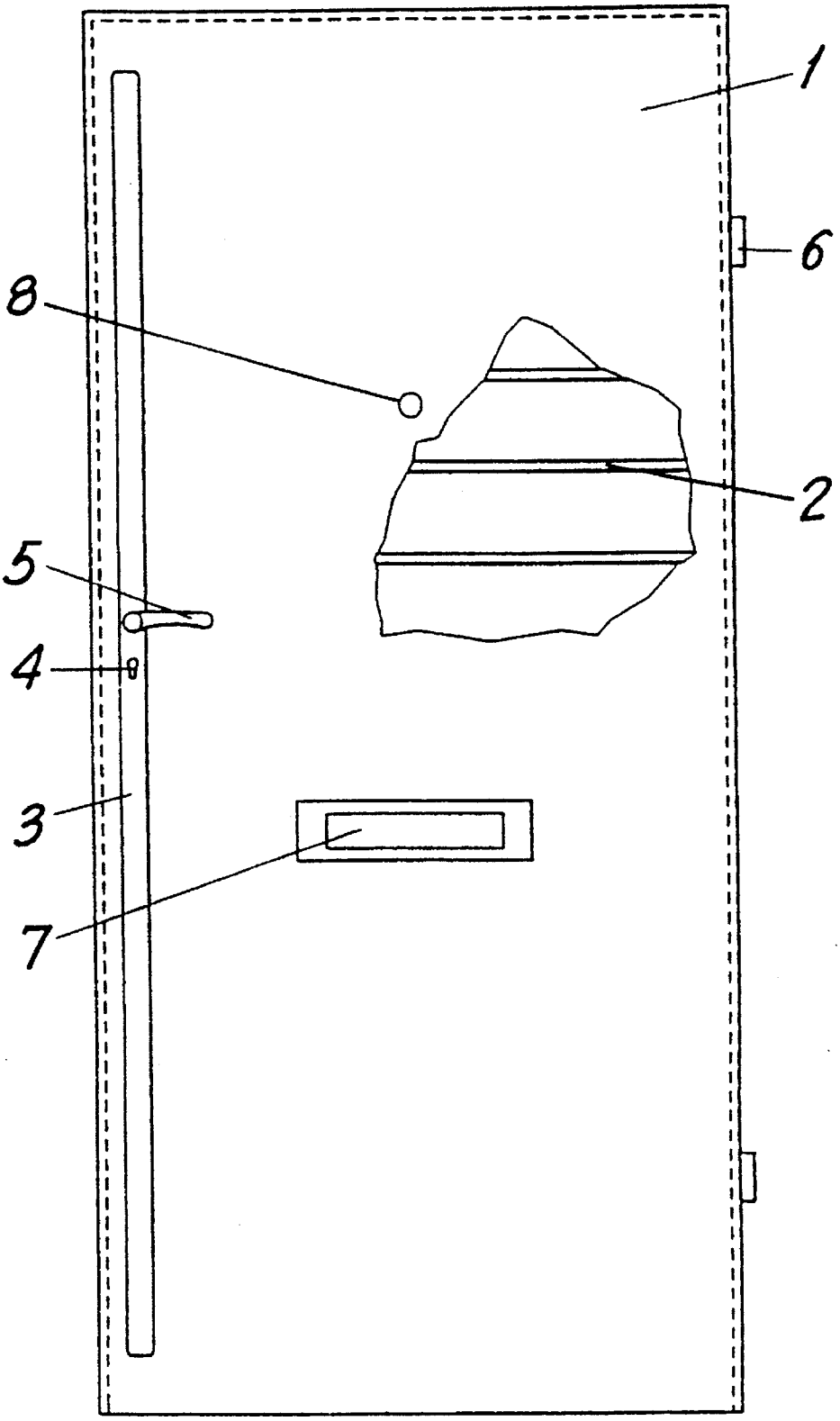
FIG. 1 shows a view of a preferred embodiment of the inventive safety door.

According to FIG. 1, door leaf 1 is penetrated by a plurality of pipes 2 running horizontally. These extend continuously between the two vertical peripheral edges of the door leaf 1.

On the inside of the door on the lock side, a covering strip 3 is provided, under which the operating mechanism for the safety bolts, movably guided in the pipes 2, is located. The covering strip has an opening 4 for the lock cylinder, as well as an opening for the latch, which is covered by the handle 5.

Metal strips 6, a mail slot 7 and a peephole 8 are provided in the conventional manner in the door leaf 1.

Figure 2:
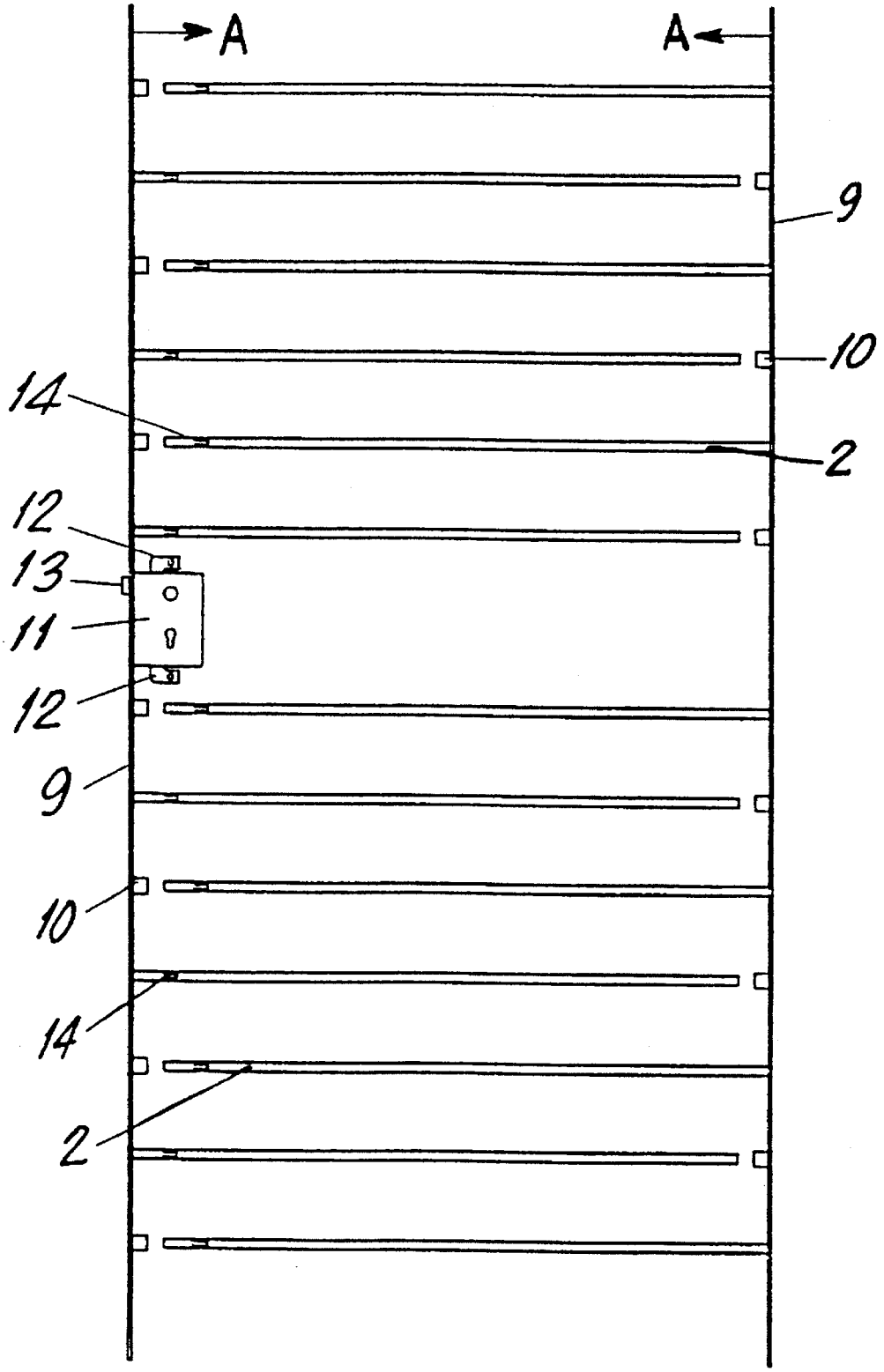
FIG. 2 shows a plan view of two "comb-like" units consisting in each case of an installation holding strap as well as a plurality of pipes connected with this strap, as used for the manufacture of a first preferred further development of the inventive safety door.

FIG. 2 illustrates the grill, which is provided in a preferred further development of the inventive door and consists of the two installation holding straps 9 as well as of the two pipes 2 extending between said straps. The grill is composed of two "comb-like" units, consisting in each case of an installation holding strap 9 as well as a plurality of pipes 2, which are firmly connected therewith. The two "comb-like" units are installed in the door leaf from mutually opposite peripheral edges of the door leaf by introducing the free ends of the pipe 2 into the cavities provided in the door leaf. Seats 10 for the free ends of those pipes 2, which are connected with the respective other installation holding strap, are provided in each installation holding strap 9. These seats have the shape of bushings, which embrace the assigned free ends of the pipes 2, when the two installation holding straps 9 are moved further apart (arrow A).

A lock box 11 is firmly connected with the left installation holding strap 9, which is assigned to the lock side of the door leaf (FIG. 1). The corresponding lock is constructed as a triple lock with three locking mechanisms. In addition, to a locking mechanism, which operates a conventional bolt (FIG. 3), the lock has two locking mechanisms 12, which can be shifted vertically in opposite directions. Furthermore, a latch 13 is provided in the usual manner.

Each of the pipes 2 is provided with an elongated hole 14. The elongated holes 14 are disposed so that, in the completely installed safety door, they are in a vertical line above and below the locking mechanisms 12. As becomes clearer from the following description, operating pins act through the elongated holes 14 onto the safety bolts accommodated longitudinally displaceably in the pipes 2.

FIG. 3 once again shows the grill structure, which was already demonstrated in FIG. 2 and comprises the two installation holding straps 9 as well as the pipes 2 extending between these two straps. In the case of the final distance between the two installation holding straps 9 shown in FIG. 3, the free end of each pipe 2 is accommodated in the assigned seat 10.

Each pipe 2 carries a longitudinally displaceable safety bolt 15. In the locked position shown in FIG. 3, the safety bolts protrude beyond the installation holding straps 9 out of the pipes 2, so that they can engage the seats, which are provided in the door frame.

A section of the slide rod 16 is connected with each of the locking mechanisms 12. The slide rod sections are aligned vertically and disposed in a line with one another and are shifted in their longitudinal direction, that is vertically, corresponding to the motion of the locking mechanisms 12 when the lock is unlocked and locked. In the locked position shown, in which the conventional bolt 17 also protrudes beyond the corresponding installation holding strap 9, the two locking mechanisms 12 and, with that, also the two sections of the slide rod 16 are pushed apart, that is, the upper slide rod section is pushed upward and the lower slide rod section is pushed downward.

To operate the safety bolts 15, an elongated hole guideway 18 is provided for each of them in the allocated section of the push rod 16. For forming wedge mechanisms, these elongated hole guideways run obliquely to the longitudinal direction of the slide rod 16. From each of the safety bolts 15, an operating pin 19 protrudes laterally and passes through the elongated hole 14 in the allocated pipe 2 as well as through the allocated elongated hole guideway 18 of the corresponding section of the slide rod 16. A vertical motion of the slide rod sections while lock 11 is being locked and unlocked is converted by the wedge mechanisms into corresponding horizontal motions of the safety bolts 15, in that the operating pins 19, as a result of the slope of the elongated hole guideways 18, are shifted in the elongated holes 14 of the pipes 2.

Figure 3:
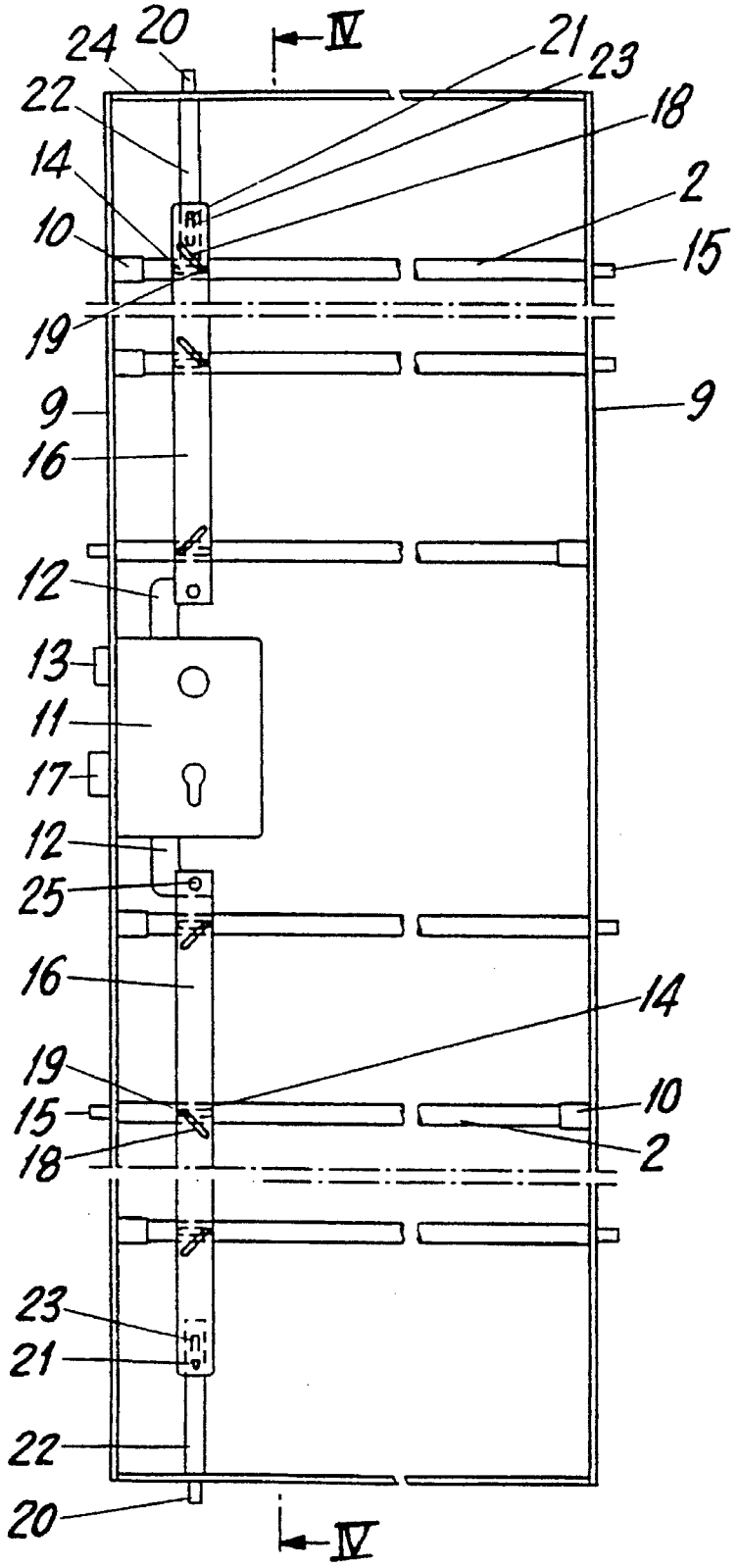
FIG. 3 shows a plan view of those mechanisms, with which a conventional door can be reequipped in a first preferred embodiment of the inventive safety door.

FIG. 3 in addition shows two further safety bolts 20, one of which acts at the upper and the other at the lower peripheral edge of the door. These safety bolts 20 are shifted over operating pins 21 directly by the two sections of the slide rod 16 into corresponding pipes 22. At the same time, the operating pins 21 pass through elongated holes 23, which are provided in the pipes 22. The pipes 22 are fastened to an upper or a lower installation holding strap 24, which extend between the ends of the vertical installation holding straps 9.

Figure 4:
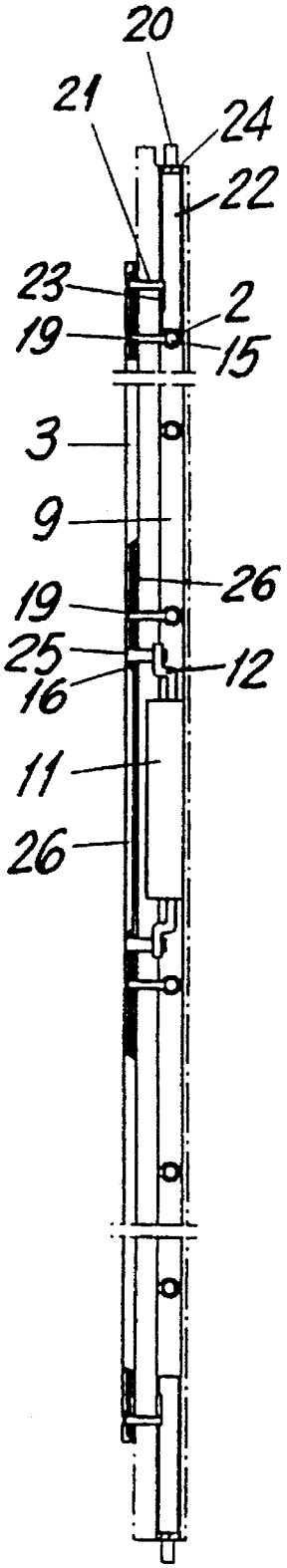
FIG. 4 shows a section along the line IV—IV of FIG. 3.

In FIG. 4, which shows a section through the arrangements of FIG. 3, identical parts have been given the same reference numbers as in FIG. 3. To this extent, reference is made to the preceding description. In addition, the two connecting bolts 25 can be recognized, which connect the two sections of the push rod 16 with the allocated locking mechanisms 12. Furthermore, a guide bar 26 for the push rod 16 and an associated covering strip 3 can be recognized, which are described in greater detail below with reference to FIG. 6.

Figure 5:
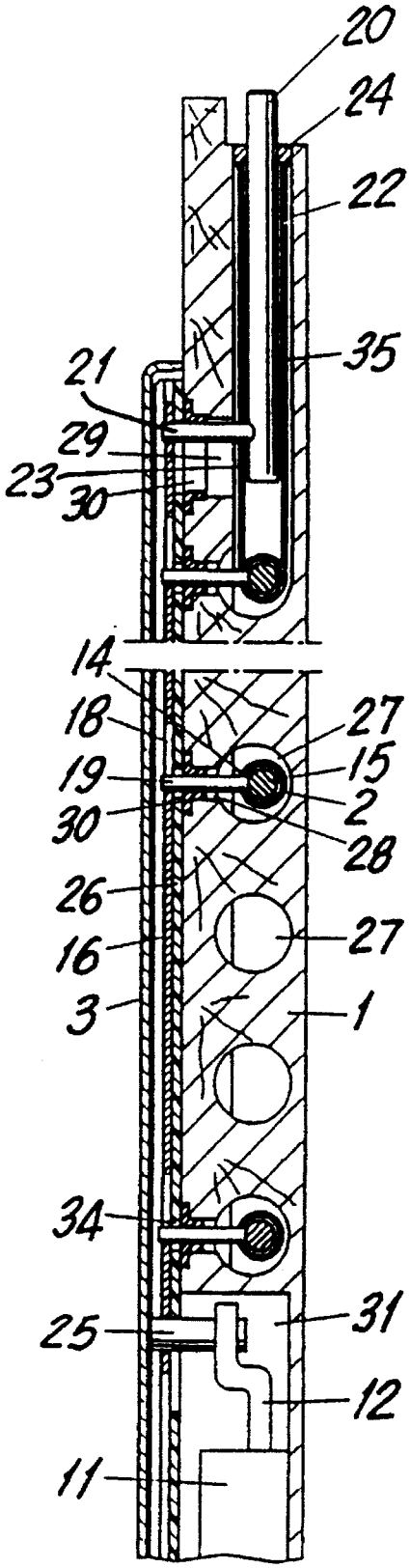
FIG. 5 shows an enlarged view of a section through a safety door, in which the mechanisms, shown in FIGS. 3 and 4, are installed.

FIG. 5 shows the arrangements of FIGS. 3 and 4 in a state, in which they are installed in a door leaf 1. The door leaf has been made from a chipboard interspersed with tubular cavities 27 in the door leaf, which are provided already in the chipboard plant and serve to accommodate the pipes 2 passing through the door leaf. Supplementarily to FIGS. 3 and 4, elongated holes 28 and 29, through which the operating pins 19 for the safety bolts 15 or the operating pins 21 for the safety bolts 20 extend, can be identified in FIG. 5. In the elongated holes of the door leaf, friction-reducing inserts 30 are accommodated, in which the operating pins 19 or 21 are guided with little friction. Furthermore, recess 31 for the lock 11, together with the locking mechanisms 12, can be seen.

Figure 6:
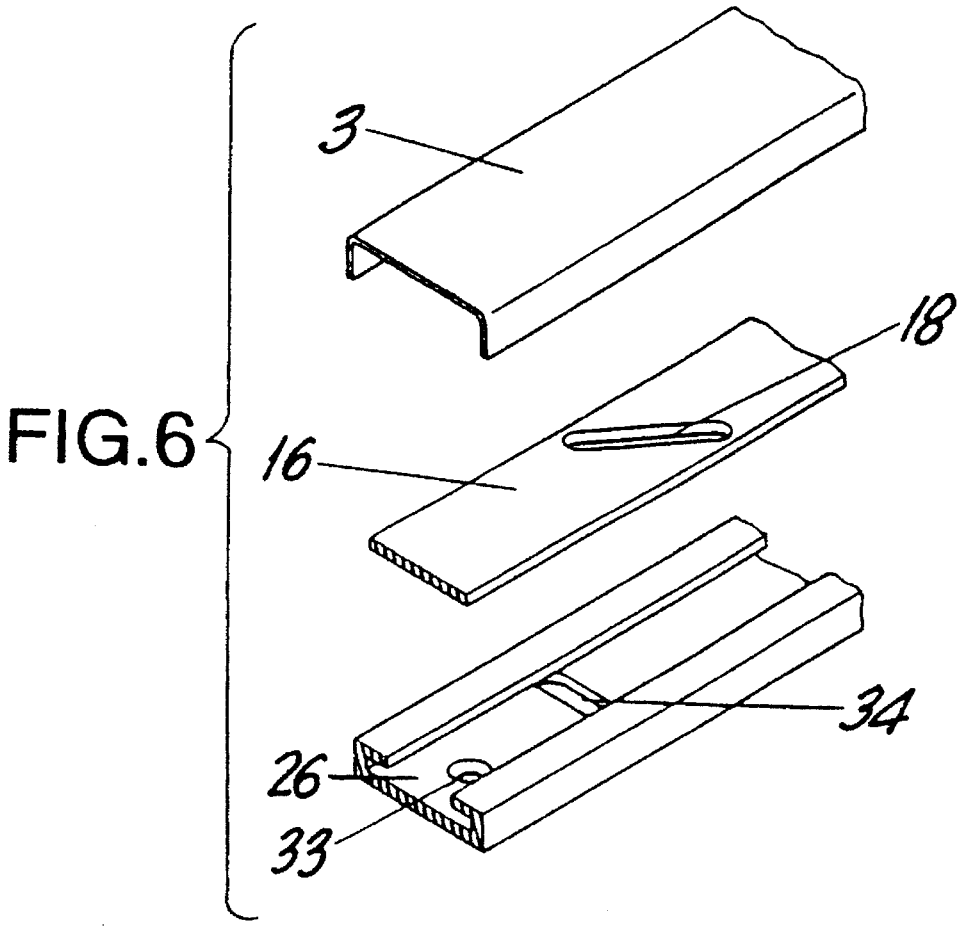
FIG. 6 shows a perspective representation of pans of an operating mechanism for the safety doors, preferably used within the scope of the invention.
Figure 7:
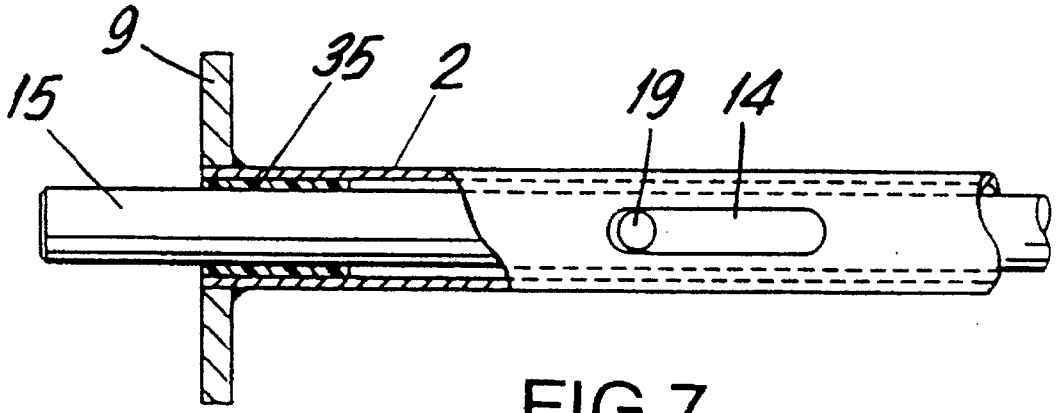
FIG. 7 shows a partially broken view of the end region of a pipe, together with the safety bolts accommodated therein.

According to FIG. 6, a guide bar 26 with a C-shaped cross section is provided for guiding the push rod 16. The guide bar 26 thus embraces the side edges of the push rod 16. The guide bar consists of a material with a low coefficient of friction. So that it can be fastened to the outside of the door leaf, the guide bar 26 has countersunk boreholes 33 for accommodating flat head bolts. Two of the fastening bolts pass through the door leaf and fix the metal fitting provided on the outside of the door. In the guide bar 26, elongated hole guideways 34 are provided, which extend transversely to the longitudinal direction of the guide bar and correspond to the elongated holes 14 in the pipes 2 (FIGS. 2, 3 and 7). In the installed state of the operating mechanism, a U-shaped profiled covering bar 3 is jammed over the guide bar 26.

FIG. 7 shows the details of the end of the pipe 2 welded to the installation holding strap 9. The safety bolt is carried in sliding bushings 35, which are accommodated in the pipe 2 and have a friction-reducing coating. The operating pin 19, which passes through the elongated hole 14 provided in the pipe, protrudes laterally from the safety bolt 15.

Figure 8:
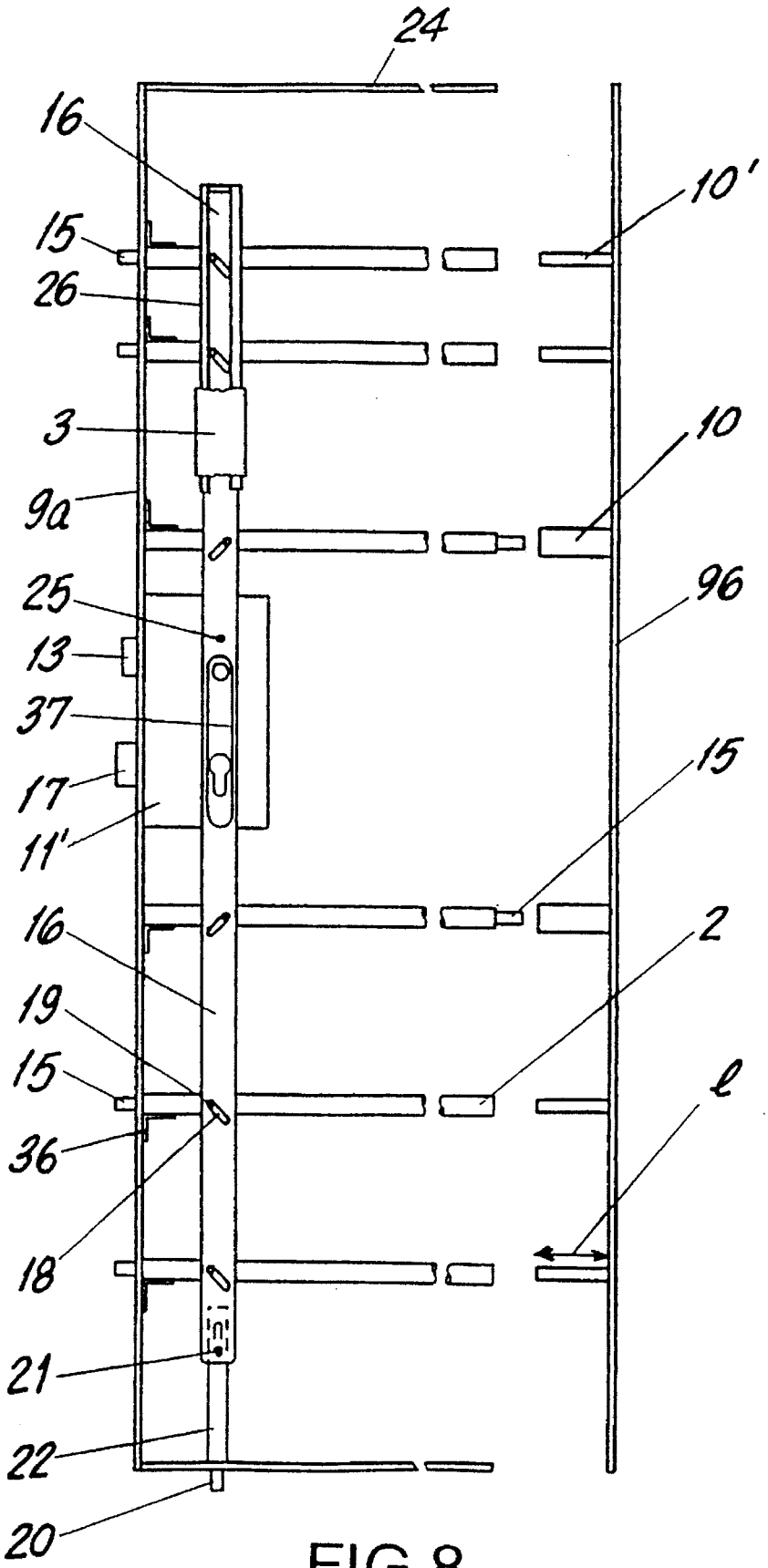
FIG. 8 shows a plan view of those mechanisms, with which a conventional door can be reequipped in a second preferred embodiment of the inventive safety door.

In a manner similar to that shown in FIG. 3, FIG. 8 illustrates a safety apparatus, with which a conventional door can be re-equipped into a safety door in accordance with a second, preferred embodiment of the invention. Aside from the differences described in the following, the basic construction of the safety apparatus of FIG. 8 corresponds to that of the safety apparatus of FIG. 3, so that reference can be made to the corresponding explanations; in particular, identical parts in the two Figures have been marked with identical reference symbols.

The safety apparatus of FIG. 8 comprises only six pipes 2 serving as guideways for the safety bolts 15. All pipes are firmly connected with the installation holding strip **9*a* on the lock side, by using support brackets 36, which are bolted in each case to the corresponding pipe 2 and to the installation holding strap 9*a*. The safety apparatus of FIG. 8 thus comprises only one "comb-like" unit. Only seats for the free ends of the pipes 2 are firmly connected, for example, by welding, with the installation holding strap 9*b* on the hinge side. The seats, moreover, are partly constructed as bushings 10, which embrace the pipes, and partly as bolts 10', which engage the pipes. Furthermore, bushings are provided for those pipes 2, for which the fastening bolts 15 act on the hinge side; these are the middle two of the six pipes 2. On the other hand, the seats for the free ends of the pipes are constructed as bolts 10' for those pipes, for which the safety bolts 15 act on the lock side; these are the two upper and the two lower pipes. The bushings 10 as well as the bolts 10' have an axial extent 1, which is large enough to compensate for permissible deviations in the case of doors of different widths. In this sense, the axial extent 1 of the bushings 10 and bolts 10'**, functioning as seats, is about 10 cm. This permits a telescopic shifting of the pipes with respect to the seats in order to compensate for possible, permissible deviations.

Contrary to the safety apparatus of FIG. 3, all safety bolts 15 are operated by a one-piece, continuous slide rod 16, which is shown in its lower position in FIG. 8, which corresponds to the locked position. Since the push rod does not have two sections guided in opposite directions but, instead, is constructed continuously, the lock is constructed as a double-acting double lock. One of the two locking mechanisms acts on the slide rod 16 and the other acts (in a known manner) on the bolt 17. The slide rod 16 is connected with the assigned, vertically acting locking mechanism over the connecting bolt 25, which protrudes, in the direction towards the inside of the door, laterally from the lock box 11'. A vertically aligned elongated hole is incorporated in the door leaf, as well as in the guide bar 26. During the operation of the lock, the connecting bolt 25 is shifted vertically in these elongated holes. For the construction of the safety apparatus of FIG. 3, two recesses must be put in place in the door leaf for the locking mechanisms 12 (see FIG. 5, recess 31). On the other hand, this is not required for the safety apparatus of FIG. 8. Rather, for the further development of the invention shown in FIG. 8, the cavity, provided in the door leaf for the lock box, need not be worked on during the re-equipping of a conventional door into one of the invention.

In the area of the lock box 11', the slide rod 16 has an opening 37, through which it is possible to operate the latch as well as the lock cylinder. The opening 37 is in the shape of an elongated hole, in order to release the latch and lock cylinder independently of the position of the slide rod.

In comparison with the safety apparatus of FIG. 3, the supplementary safety bolt provided at the upper edge of the door leaf is omitted for that of FIG. 8. Rather, the further development of the invention shown in FIG. 8 has only one vertically displaceable safety bolt 20, and, moreover, at the lower edge of the door leaf, acting into the threshold. In conjunction with the lowest safety bolt 15 acting at the lock side, this supplementary safety bolt secures the most endangered place of the door during breaking and entering, namely the lower corner on the lock side.

I claim:

1. A safety door comprising a door leaf (1); safety bolts (15) provided at two mutually opposite peripheral edges of the door leaf (1); installation holding straps (9); a locking mechanism apparatus for shifting said safety bolts in assigned guideways in such a manner that, in a locked position, said safety bolts protrude beyond the corresponding peripheral edge of the door leaf and, in an unlocked position, said safety bolts are accommodated within the door leaf, the locking mechanism apparatus comprising a slide rod (16), which can be shifted in a longitudinal direction thereof and which runs essentially transversely to the guideways and with which the safety bolts (15) are coupled mechanically, wherein precisely one safety bolt (15) is carried in each guideway and the safety bolts, allocated to the one peripheral edge and the opposite peripheral edge, are disposed offset with respect to one another, and wherein said guideways are formed as pipes (2) extending transversely through the whole of the door leaf (1) and are connected at their opposite ends to said installation holding straps (9), which extend along said peripheral edges of the door leaf (1) and connect all pipes (2) with one another.

2. The safety door of claim 1, wherein six laterally acting safety bolts are provided on said door leaf, of which two lower and two upper safety bolts act on a lock side and remaining two safety bolts in the middle act on a hinge side.

3. The safety door of claim 1, further comprising a lock box (11), provided for operating the locking mechanism apparatus and connected with one of the installation holding straps (9).

4. The safety door of claim 1, wherein the safety bolts (15) are coupled with the slide rod (16) by wedge mechanisms, which comprise elongated hole guideways (18) provided in the slide rod (16) and running transversely to a longitudinal direction of the slide rod (16), all the elongated hole guideways being disposed on one line.

5. The safety door of claim 4, further comprising a guide bar (26), the slide rod (16) being carried in said guide bar (26) having a C-shaped profile and placed outside on the inside of the door leaf (1).

6. The safety door of claim 5, wherein the guide bar (26) is connected by fastening elements passing through the door leaf with a metal fitting placed outside on the outside of the door leaf.

7. The safety door of claim 5, wherein the guide bar (26) has elongated hole guideways (34) extending transversely to the longitudinal direction of said guide bar (26).

8. The safety door of claim 1, further comprising a covering strip (3), and wherein an operating mechanism for the safety bolts is covered by said covering strip (3), which has one opening (4) for a lock cylinder of a lock and one opening for a latch.

9. The safety door of claim 3, wherein the lock box (11) comprises a double lock, one of the locking mechanisms (12) acting on the vertically displaceable slide rod (16) assigned to the locking mechanism apparatus and the second locking mechanism operating a conventional bolt.

10. The safety door of claim 4, further comprising pins (19) and friction-reducing guideway inserts (30) for operating said pins (19) which are assigned to the safety bolt (15), said inserts being provided in elongated holes (28) of the door leaf (1) and corresponding to elongated holes (14) provided in the pipes (2).

11. The safety door of claim 1, wherein said pipes (2) run essentially parallel to one another and said safety bolts are longitudinally displaceable and carried within said pipes (2) and can be shifted by a common locking mechanism apparatus between a locked position, in which they protrude from the assigned pipes, and an unlocked position, in which they are taken up at least partially in the pipes, and one safety bolt (15) is carried in each pipe (2) and the safety bolts are mutually offset so as to form at least one comb-shaped unit which consists of one installation holding strap (9) and a number of pipes (2) firmly connected with said strap (9).

* * * * *